US005127244A

United States Patent [19]

Myers

[11] Patent Number: 5,127,244

[45] Date of Patent: Jul. 7, 1992

[54] SHACKLELESS PADLOCK

[75] Inventor: Gary L. Myers, River Grove, Ill.

[73] Assignee: K.X.L. Manufacturing, Inc., River Groove, Ill.

[21] Appl. No.: 746,621

[22] Filed: Aug. 19, 1991

[51] Int. Cl.[5] ..... E05B 65/48

[52] U.S. Cl. ..... 70/2; 70/14; 70/32; 70/34; 70/417

[58] Field of Search ..... 70/2, 6-12, 70/14, 23, 32-34, 51, 52, 370, 371, 417

[56] References Cited

U.S. PATENT DOCUMENTS

| | | | |
|---|---|---|---|
| 924,331 | 6/1909 | Feola | 70/14 X |
| 1,432,326 | 10/1922 | Freysinger | 70/417 X |
| 1,579,736 | 4/1926 | Stone | 70/417 |
| 1,642,326 | 9/1927 | Bleoo | 70/417 X |
| 1,783,905 | 12/1930 | Copell | 70/32 |
| 2,104,981 | 1/1938 | Falk | 70/33 |
| 2,166,660 | 7/1939 | Handshy et al. | 70/9 |
| 2,458,046 | 1/1949 | Audet | 70/6 X |
| 2,656,704 | 10/1953 | Mancuso | 70/32 X |
| 3,769,821 | 11/1973 | Randel . | |
| 3,817,062 | 6/1974 | Randel . | |
| 3,901,058 | 8/1975 | Best | 70/6 X |
| 3,914,965 | 10/1975 | Paxton | 70/34 |
| 4,013,311 | 3/1977 | Prezioso | 70/417 X |
| 4,345,448 | 8/1982 | Solomon | 70/2 X |
| 4,409,805 | 10/1983 | Wang | 70/32 |
| 4,754,626 | 7/1988 | Siegel . | |
| 4,953,371 | 9/1990 | Appelbaum . | |

FOREIGN PATENT DOCUMENTS

| | | | |
|---|---|---|---|
| 1380239 | 1/1975 | United Kingdom | 70/9 |

*Primary Examiner*—Renee S. Luebke
*Assistant Examiner*—Suzanne L. Dino
*Attorney, Agent, or Firm*—Leydig, Voit & Mayer

[57] ABSTRACT

An improved shackleless padlock which engages and secures a conventional hasp configuration by use of a pop-out lock mechanism which has a non-rotating cylindrically extending lock bolt that engages the hasp staple. The pop-out lock mechanism is created by use of a spring to bias the lock mechanism outwardly from the padlock body when the lock contained within the lock shell is in a locked position, the lock mechanism is pushed inwardly into the padlock body until it latches into a fixed position and the lock bolt consequently engages the hasp staple. Strength is added to the die cast metal alloy construction of the padlock body by use of vertical and horizontal hardened, force-fit pins embedded in the padlock body. Also, a material saving well is formed in the top face of the padlock body which may also be utilized for displaying a nameplate.

10 Claims, 2 Drawing Sheets

SHACKLELESS PADLOCK

FIELD OF THE INVENTION

The present invention relates generally to padlock devices for hasps, and more particularly to an improved construction for a shackleless lock.

BACKGROUND OF THE INVENTION

The shackleless padlock has been widely used to prevent unlawful access. Various shackleless locks are illustrated and described in Randel U.S. Pat. No. 3,769,821 issued Nov. 6, 1973, entitled "Lock Device for Securing Apertured Members"; Randel U.S. Pat. No. 3,817,062 issued Jun. 18, 1974, entitled "Lock Device for Securing an Apertured Member"; and Siegel U.S. Pat. No. 4,754.626, issued Jul. 5, 1988, entitled "Shackleless Lock Protector." Typically, the shackleless lock is used with a hasp type arrangement on adjoining doors or a door contiguous to a fixed wall to prevent unwanted access beyond the door or doors.

In such prior shackleless locks it has been common to provide rotation of a shaped or cam-like lock bolt with the key rotation. Often difficulty is encountered with aligning the lock bolt and passing it through the hasp staple. In addition, these prior locks typically provide for manual sliding movement of the lock plug and lock bolt with the use of the key to engage or subsequently disengage the hasp staple.

Also, conventionally, the lock body has been made from a die cast metal alloy composition to keep manufacturing costs at a minimum. However, a die cast lock body is susceptible to being cut or broken. To give the die cast lock body additional strength, hardened pins have been force fit into holes which are perpendicularly made into the rear face of the lock body at various points near the perimeter of the rear face. Unfortunately, this technique has not completely eliminated lock body breakage or penetration.

OBJECTS AND SUMMARY OF THE INVENTION

The primary aim of the present invention is to provide an improved shackleless lock which is suitable for use with a hasp and which has a novel "pop-out" lock mechanism. Additionally, an objective of this invention is to avoid alignment difficulties when inserting the lock bolt through the staple of the hasp. The invention accomplishes these objectives by use of a cylindrical non-rotating lock bolt connected to a sliding "pop-out" lock shell. A spring is used to aid the outward movement of the lock shell from the lock body when a key is used to bring the lock into the unlocked position. The key operated lock may be key retaining or non-key retaining in this open (unlocked) position. The quick outward movement of the lock shell caused by the spring is the "pop-out" feature. Consequently, the lock bolt will disengage the hasp staple and allow removal of the lock from the hasp. This lateral movement of the lock mechanism is further confined by a stop means. Upon bringing the lock back into the locked position, the cylindrical construction of the lock bolt without any protruding members at the end of the lock bolt allows for ease of alignment and insertion of the lock bolt through the hasp staple for the engagement of the lock bolt and lock mechanism.

Another objective of this improved shackleless lock is to afford improved security and structural integrity.

The invention accomplishes this by installing a hardened, force fit steel pin in a horizontal hole that runs parallel to the top face of the lock. This pin bolsters the strength of the die cast lock body making the shackleless lock more difficult to destroy.

An additional objective is to reduce the amount of material needed to make the die cast lock body, thereby minimizing manufacturing costs, by means of a material saving well on the top face of the lock body which may be varied in size, shape, or depth.

A further objective is to provide such an area for a material saving well on the front face of the lock body which can further receive a nameplate or the like for source as well as aesthetic identification.

These and other objectives and advantages of this invention will become more apparent from the following detailed description when taken in conjunction with the accompanying drawings. BRIEF DESCRIPTION OF THE DRAWINGS FIG. 1 is a perspective view of the preferred embodiment of the shackleless lock engaging a hasp configuration with the locking mechanism shown engaging the hasp staple.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
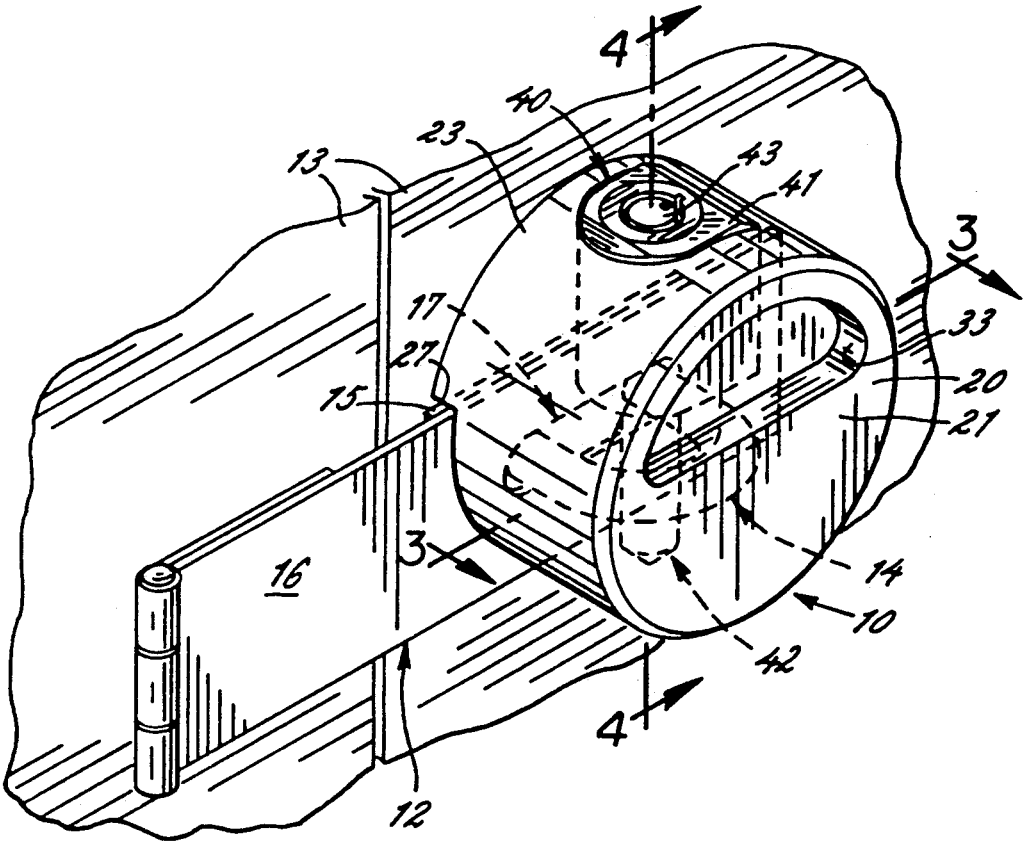

As shown in FIG. 1 this invention contemplates the improvement of a shackleless padlock generally designated as 10 for engaging and securing a typical hasp configuration 12 which is used to maintain adjoining doors 13 in a closed manner. The hasp 12 generally includes a hasp staple 14 mounted to a bracket 15 and a hinged hasp arm 16 which passes over the hasp staple 14 through a slot 17 when the doors 13 are in a closed position. The bracket 15 and the hinged hasp arm 16 are mounted to the adjoining doors 10 by means of screws 18.

Figure 3:
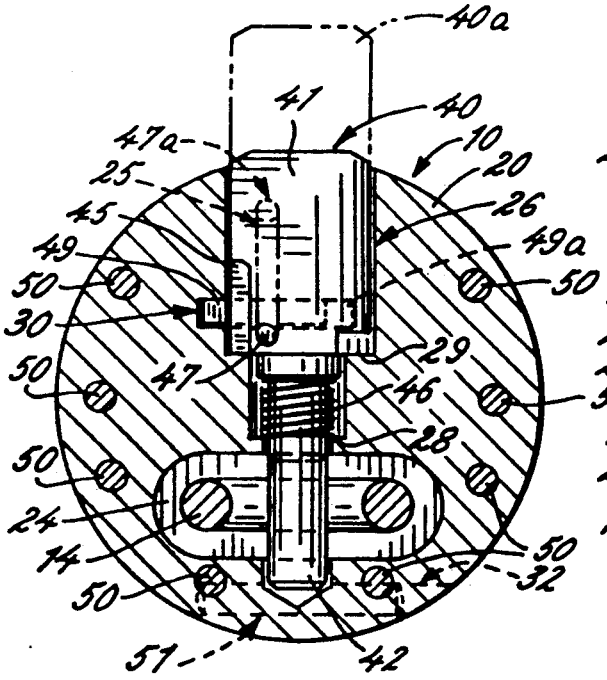
FIG. 3 is a cross-sectional rear view taken along the lines 3—3 in FIG. 1, but with a phantom view of the locking mechanism in its unlocked, "pop-out" position.
Figure 2:
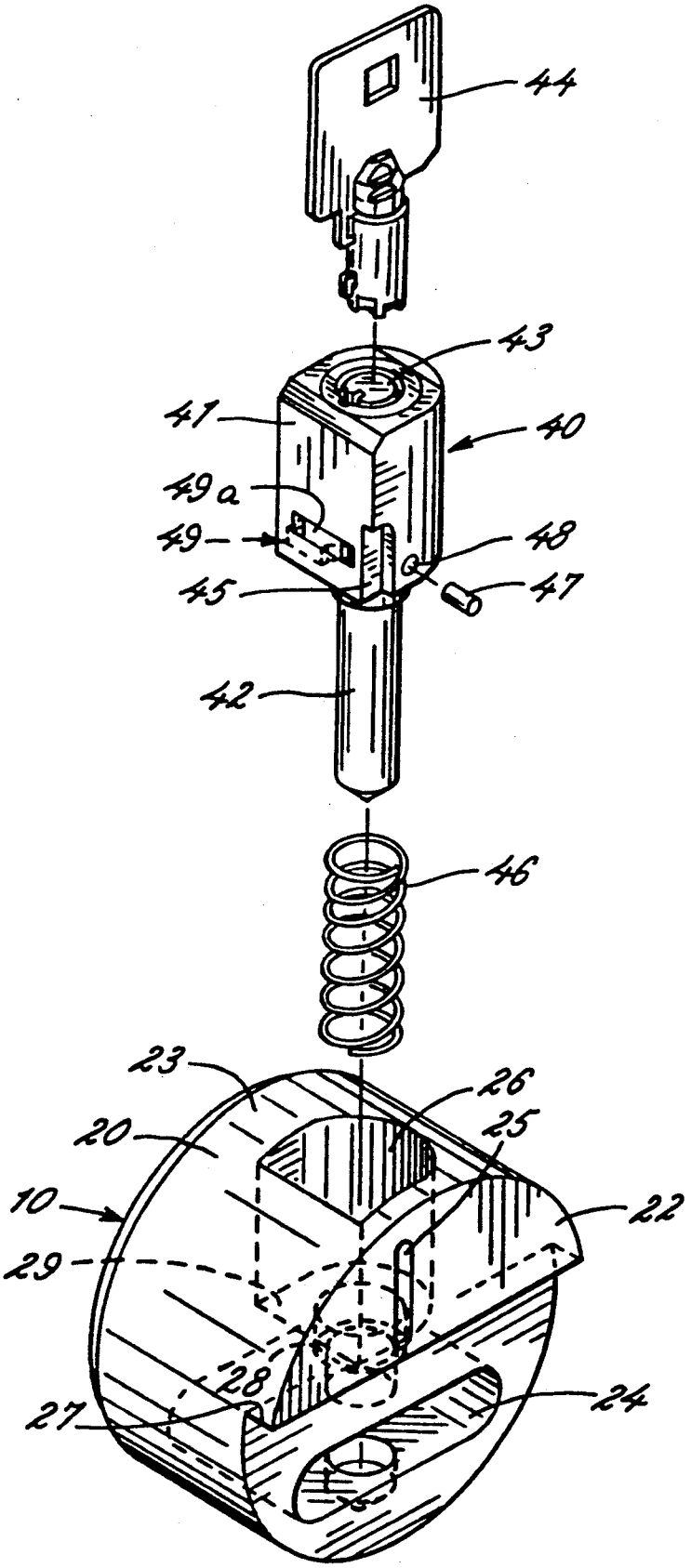
FIG. 2 is a perspective view of the preferred embodiment of the shackleless lock with the locking mechanism exploded out of the lock body.

The typical shackleless padlock 10 is constructed from a cylindrical body 20 having a top wall 21, bottom wall 22 and a side wall 3. As illustrated in FIG. 2, the padlock body 20 has a slotted recess 24 in the bottom wall 22, a slot 25 in the bottom wall a horizontal bore 26 into the side wall 23 which intersects and passes through the slotted recess 24, and a stop ledge 27 on the bottom wall 22. As shown in FIG. 3, the horizontal bore 26 has a step 28 above the intersection of the horizontal bore 26 and the slotted recess 24, a step 29 above the step 28 and an inset groove 30 above the step 29. In the preferred embodiment of the shackleless padlock 10, the padlock body also has vertical holes 31 in the bottom wall 22, a horizontal hole 32 in the side wall 23 and a recessed well 33 in the top wall, and the horizontal bore 26 has a guide 34 that projects outward from the step 29. To engage the hasp 12, the slotted recess 24 of the padlock body 20 passes over the hasp staple 14 and the stop ledge 27 rests upon the upper edges of the bracket 15 and the hinged hasp arm 16. The stop ledge 27 also acts as a mechanical deterrent to unwanted removal of the padlock 10 from the hasp 12 when the shackleless padlock 10 is in the locked position.

In general, the lock mechanism 40 consists of a lock shell 41 and an inwardly extending lock bolt 42. In its preferred embodiment, the outward face of the lock shell 41 and portion of the horizontal bore 26 which accommodates the lock shell 41 are "D" shaped. The lock shell 41 contains a lock 43 which is operated by a key 44. The lock 43 is preferably an axial pin tumbler type lock because this type of lock provides much higher security as compared to most other lock means, however other lock means may be used.

The lock mechanism 40 is positioned within the horizontal bore 26 with the notch 45 in the lock shell 41 aligned to engage the guide 34. In accordance with one aspect of this invention, the lock bolt 42 is cylindrical, non-rotating and integrally constructed with the lock shell 41. Also, the end of the lock bolt 42 is beveled or tapered. These features allow the lock bolt 42 to engage the hasp staple 14, quickly, easily, and without interference from protruding members at the end of the lock bolt 42 when the lock mechanism 40 is depressed inward through the horizontal bore 26.

In accordance with an important aspect of this invention, the lock bolt 42 is inserted through a spring 46 within the horizontal bore 26. The spring 46 is confined within the horizontal bore 26 by the step 28 and the inward face of the lock shell 41. Additionally, a stop pin 47 is inserted in a hole 48 in the lock shell 41. The stop pin 47 slides within the slot 25. The slot 25 is formed in the bottom wall 22 of the padlock body 20 and extends inwardly into the horizontal bore 26. This stop pin 47 nd slot 25 configuration confines the inward and outward movement of the lock mechanism 40 within the horizontal bore 26 relative to the padlock body 20. A press fit plug (not shown) is placed over the groove 30 to prevent latch 49 from being manipulated when lock bolt 42 is engaged in hasp 14 (locked position).

Figure 4:
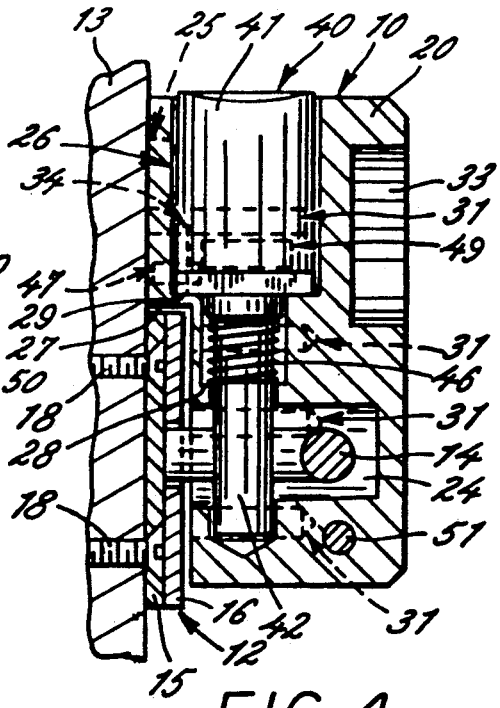
FIG. 4 is a cross-sectional side view taken along the lines 4—4 in FIG. 1.

When the lock mechanism 40 is in the fully depressed position and the lock bolt 42 engages the hasp staple !4 and rests in the bottom of the horizontal bore 26 (as shown in FIGS. 3 and 4), latch 49 projects laterally from the lock shell 41 and engages the groove 30 in the horizontal bore 26. The latch 49 maintains the lock mechanism 40 in the depressed position against the recoil force of the compressed spring 46. The lock 43 controls the movement of the latch 49 and is in a locked position when the lock mechanism 40 is maintained in a depressed position by the latch 49. Regarding the important aspect of this invention, when the lock 43 is brought into an unlocked position by the key 44, the latch 49*a* recedes into the lock shell 41 and disengages the groove 30 which allows the compressed spring 46 to quickly force the lock mechanism 40*a* outward from the padlock body 20. This "pop-out" movement of the lock mechanism 40*a* is limited by the stop pin 47*a* and slot 25 configuration (see FIG. 3). Consequently to the "pop-out" of the lock mechanism 40*a*, the lock bolt 42 disengages the hasp staple 14 which allows for quick and easy removal of the shackleless padlock 10 from the hasp 12.

Conventionally, the shackleless padlock body 20 is made from a die cast alloy construction. However, the use of a die cast construction for the shackleless padlock 10 ultimately reduces the strength and structural integrity of the lock. To improve both the strength and structural integrity of the shackleless padlock 10, this invention contemplates the use of hardened pins 50 and 51 embedded within the padlock body 20. Hardened pins 50 are force fit into vertical holes 31 in the bottom wall 22 of the padlock body 20. In addition, a hardened pin 51 is embedded in a horizontal hole 32 in the side wall 23 of the padlock body 20 (see FIG. 3). This horizontal pin 51 adds strength and structural integrity to the transverse plane of the lock body, particularly in the area of the slotted recess 24 which covers the hasp staple 14.

In accordance with an additional important aspect of this invention, a recessed well 33 is formed in the top wall 21 of the padlock body 20. This well 33 reduces the amount of material required to produce the padlock body 20 which minimizes manufacturing costs. Also, this well 33 provides an ideal means for locating a nameplate (not shown), but it will be appreciated that such nameplate would be shaped similarly to the shape of the well 33 and inserted therein for identification of source and aesthetics.

I claim as my invention:

1. A shackleless padlock for locking hasp members including an upstanding staple, comprising in combination:

a body having a top, bottom and side walls, said body having means defining a slotted recess in said bottom wall for receiving said hasp staple, and an inwardly extending horizontal bore from said side wall interconnected with said slotted recess, a pop-out lock shell which is inwardly and outwardly movable in said horizontal bore of said body, said lock shell having a non-cylindrical "D" shape, carrying a rotatable key operated lock means at its outer end and having a bolt means disposed inwardly from the shell and adapted to pass transversely through said slotted recess when said lock shell is in the depressed position, said bolt means being integrally constructed with said lock shell and having an outer diameter which is less than that of said lock shell, said bolt means and said lock shell being disposed in axial relation within said inwardly extending horizontal bore.

a spring means for biasing said lock shell outwardly with respect to said horizontal bore of said body, said spring means being disposed over said bolt means in axial relation with said lock shell, a stop means for limiting the outward movement of said lock shell, said stop means comprising a laterally projecting pin carried by said lock shell which slides and is configured within a slot in said bottom wall of said body that extends inwardly to said horizontal bore, a latching means carried within the lock shell disposed in said horizontal bore and operated by the proper rotatable key with said lock means that maintains said lock shell in the recessed position within said horizontal bore, said latching means being normally acting with groove means in said horizontal bore to secure the lock shell in the recessed position, and a material saving well recessed into said outer top wall of said body.

2. A shackleless padlock as claimed in claim 1 wherein said bolt means is non-rotatable and cylindrically shaped without protruding members at its end.

3. A shackleless padlock as claimed in claim 2 wherein said bolt means has a beveled end.

4. A shackleless padlock as claimed in claim 1 wherein said lock means is a non-key retaining type lock and said latching means snaps closed when said lock shell is slid into said recessed position with the key removed.

5. A shackleless padlock as claimed in claim 1 wherein said latching means projects laterally from said lock shell an engages a groove in the wall of said horizontal bore.

6. A shackleless padlock for locking hasp members including an upstanding staple, comprising in combination:

a body having a top, bottom and side walls, said body having means defining a slotted recess in said bottom wall for receiving said hasp staple, and an inwardly extending horizontal bore from said side wall interconnected with said slotted recess, a pop-out lock shell which is inwardly and outwardly movable in said horizontal bore of said body, said lock shell carrying a rotatable key operated lock means at its outer end and having a bolt means disposed inwardly from the shell and adapted to pass transversely through said slotted recess when said lock shell is in the depressed position, said bolt means being integrally constructed with said lock shell and having an outer diameter which is less than that of said lock shell, said bolt means and said lock shell being disposed in axial relation within said inwardly extending horizontal bore, a spring means for biasing said lock shell outwardly with respect to said horizontal bore of said body, said spring means being disposed over said bolt means in axial relation with said lock shell, a stop means for limiting the outward movement of said lock shell, said stop means comprising a laterally projecting pin carried by said lock shell, and a latching means carried within said lock shell disposed in said horizontal bore and operated by the proper rotatable key with said lock means that maintains said lock shell in the recessed position within said horizontal bore, said latching means being normally acting with groove means in said horizontal bore to secure the lock shell in the recessed position.

7. A shackleless padlock as claimed in claim 6 wherein said shape of said lock shell is non-cylindrical.

8. A shackleless padlock for locking hasp members including an upstanding staple, comprising in combination:

a die cast metal alloy body having a top, bottom and side walls, said body having means defining a slotted recess in said bottom wall for receiving said hasp staple, and an inwardly extending horizontal before from said side wall interconnected with said slotted recess, a lock shell which is inwardly and outwardly movable in said horizontal bore of said body, said lock shell carrying a key operated lock means at its outer end and having a bolt means disposed inwardly from the shell and adapted to pass transversely through said slotted recess when said lock shell is in the depressed position, said bolt means being integrally constructed with said lock shell and having an outer diameter which is less than that of said lock shell, said bolt means and said lock shell being disposed in axial relation within said inwardly extending horizontal bore, a spring means for biasing said lock shell outwardly with respect to said horizontal bore of said body, said spring means being disposed over said solid bolt means in axial relation with said lock shell, a stop means for limiting the outward movement of said lock shell, and a plurality of vertical hardened pins and at least one horizontal hardened pin embedded in said body.

9. A shackleless padlock for locking hasp members including an upstanding staple, comprising in combination:

a body having a top, bottom and side walls, said body having means defining a slotted recess in said bottom wall for receiving said hasp staple, and an inwardly extending horizontal bore from sad side wall interconnected with said slotted recess, a lock shell which is inwardly and outwardly movable in said horizontal bore of said body, said lock shell carrying a rotatable key operated lock means at its outer end and having a bolt means disposed inwardly from the shell and adapted to pass transversely through said slotted recess when said lock shell is in the depressed position, said bolt means being integrally constructed with said lock shell and having an outer diameter which is less than that of said lock shell, said bolt means and said lock shell being disposed in axial relation within said inwardly extending horizontal bore, a spring means for biasing said lock shell outwardly with respect to said horizontal bore of said body, said spring means being disposed over said bolt means in axial relation with said lock shell, a latching means carried within the lock shell disposed in said horizontal bore and operated by the proper rotatable key with said lock means that maintains said lock shell in the recessed position within said horizontal bore, said latching means being normally acting with groove means in said horizontal bore to secure the lock shell in the recessed position, and a material saving well recessed into said outer top wall of said body.

10. A shackleless padlock as claimed in claim 9 wherein a nameplate is set into said recessed well.

* * * * *